US008001798B2

(12) United States Patent
Roth et al.

(10) Patent No.: US 8,001,798 B2
(45) Date of Patent: Aug. 23, 2011

(54) EXPANSION VALVE, IN PARTICULAR FOR A COOLING-MEDIUM SYSTEM

(75) Inventors: Siegfried Roth, Gerlingen (DE); Albrecht Waldenburg, Stuttgart (DE); Uta Andrä, Lichtenwald (DE)

(73) Assignee: Otto Egelhof GmbH & Co. KG, Fellbach (DE)

( * ) Notice: Subject to any disclaimer, the term of this patent is extended or adjusted under 35 U.S.C. 154(b) by 71 days.

(21) Appl. No.: 12/583,654

(22) Filed: Aug. 24, 2009

(65) Prior Publication Data

US 2010/0065770 A1 Mar. 18, 2010

Related U.S. Application Data

(62) Division of application No. 11/268,795, filed on Nov. 8, 2005, now abandoned.

(30) Foreign Application Priority Data

Nov. 8, 2004 (DE) ..... 10 2004 054 119
Oct. 18, 2005 (DE) ..... 10 2005 050 086

(51) Int. Cl.
*F25B 41/04* (2006.01)

(52) U.S. Cl. ..... 62/225; 62/527

(58) Field of Classification Search ..... 62/222, 62/225, 527; 251/333
See application file for complete search history.

(56) References Cited

U.S. PATENT DOCUMENTS 3,875,757 A * 4/1975 Amano ..... 62/115
6,062,484 A * 5/2000 Eybergen ..... 236/92 B

* cited by examiner

*Primary Examiner* — Melvin Jones
(74) *Attorney, Agent, or Firm* — Kriegsman & Kriegsman

(57) ABSTRACT

The invention relates to an expansion valve, in particular for a vehicle air-conditioning system operated with cooling medium, with a valve seat (37) and a valve-closing element (39), which closes a passage opening (44) between a cooling medium inlet opening (14) and a cooling medium outlet opening (16), and with an actuating device (46) which acts on the valve-closing element (39) and opens and closes the passage opening (44), a shortened maximum working lift for opening the valve-closing element (39) out of the valve seat (37) being provided, at which a ball seat cross section formed between valve-closing element (39) and valve seat (37) is designed to be smaller than an annular gap cross section formed between a transmission pin (47) of the actuating device (46) and a passage opening (44).

11 Claims, 3 Drawing Sheets

EXPANSION VALVE, IN PARTICULAR FOR A COOLING-MEDIUM SYSTEM

CROSS-REFERENCE TO RELATED APPLICATIONS

The present application is a divisional of U.S. patent application Ser. No. 11/268,795, filed Nov. 8, 2005 now abandoned, the disclosure of which is incorporated herein by reference.

BACKGROUND OF THE INVENTION

The invention relates to an expansion valve, in particular for an air-conditioning system operated with cooling medium, with a valve seat and a valve-closing element, which closes a passage opening between a cooling-medium inlet opening and a cooling-medium outlet opening, and with an actuating device which acts on the valve-closing element and opens and closes the passage opening.

In vehicles, it is becoming increasingly common to equip air-conditioning systems with at least one additional evaporator in order for it to be possible to cool separately at the front and at the rear or on the left and the right side, for example. To avoid unnecessary energy consumption, it is desirable for it to be possible to switch the additional evaporator off when there is no requirement. However, separate switch-off valves arranged in the cooling-medium line are relatively costly and require additional construction space.

Expansion valves which combine such separate switch-off valves in one expansion valve have therefore already become known. To this end, to switch off the additional evaporator circuit, a flowthrough opening arranged in the expansion valve is closed completely by a valve-closing element arranged in a valve seat. The activation of the valve-closing element is effected by means of an actuating device which comprises a thermohead and a transmission pin which acts on the valve-closing element. In this way, a mass flow flowing through the passage opening is controlled.

The previously known expansion valves are intended for use for high capacities. The flow rate of the cooling-medium mass flow is limited by a maximum working lift of the valve-closing element, an annular gap cross section formed between the transmission pin and the passage opening always being designed to be larger than a cross-sectional area between the valve-closing element and the valve seat in the working lift. By virtue of this, valve regulation takes place via the ball-valve seat cross section. Such expansion valves have a large working lift and are used for mass flows >100 kg/h at a condensation temperature of 38° C., undercooling of 5 K and an evaporation temperature of 0° C., for example. Such expansion valves are very inaccurate for the control of small mass flows. Moreover, the efficiency of a cooling-medium system decreases if a small mass flow is operated with such expansion valves.

SUMMARY OF THE INVENTION

The object of the invention is therefore to produce an expansion valve which has an optimum response characteristic and output result for a low output.

According to the invention, this object is achieved by the features of Claim 1.

According to the invention, this object is achieved by means of a shortened working lift of the actuating device, by means of which lifting-off of the valve-closing element from the valve seat is provided, a ball seat cross section thus formed between the valve-closing element and the valve seat being smaller than an annular gap formed between the transmission pin and a passage opening, or the area thus formed. This ball seat cross section is designed as an annular area between the valve-closing element and the valve seat and is in this connection adapted in its area to the small output of the mass flow to be limited, so that passage limitation is provided at a maximum working lift.

According to an advantageous development of the invention, the actuating device comprises a transmission pin which is matched in length and at maximum working travel of a thermohead of the actuating device brings about a shortened working lift of the valve-closing element. By virtue of the matched design, it is possible for a conventional expansion valve for high mass flows to be adaptable and convertible to an expansion valve with small output by exchanging a shortened transmission pin.

The adapted transmission pin, or the lift-limiting pin, is preferably designed in a ratio to the previous transmission pin, or non-lift-limiting transmission pin, of equal to or greater than 0.97. In this connection, a length between the valve-closing element and an actuating device, in particular a membrane of a thermohead, is taken as a basis, irrespective of whether the transmission pin is designed as one part or a number of parts.

A limited maximum working lift in a range between 0.1 and 0.5 mm is preferably provided. By virtue of this, the opening characteristic, or a rapid increase in the mass flow, can be maintained, limitation of the maximum mass flow being adjustable by means of the length of the transmission pin and limitation of the mass flow preferably being made possible as a function of the shortening of the transmission pin.

According to a further advantageous development of the invention, a thermohead of the actuating device comprises a membrane which divides the thermohead into a lower and an upper chamber and receives a filling medium with an elevated pressure in the upper chamber. In this way, the membrane can be prestressed, by virtue of which the shortened transmission pin bears against the valve-closing element in a closing position and noise-minimized actuation of the valve is made possible.

According to a further alternative embodiment of the invention, the upper chamber provided in the thermohead is filled with a filling medium which is different from the cooling medium. By virtue of this, the opening characteristic can be adjusted in order to set a steep or flat opening characteristic curve for activating the valve-closing element. In addition, the filling pressure can be varied.

According to a further advantageous development of the invention, instead of a shortened valve-closing element, a pressure-transmission element with a stop is provided in the thermohead, which pressure-transmission element is guided axially movably in a guide element, and the working travel is adjustable. Such a guide element is fastened in the housing of the thermohead for example, pressed in for example, and receives the pressure-transmission element. The lift movement can be limitable as a function of the adjustment of the free distance of a travel between the pressure-transmission element and the guide element. In addition, at least one stop or shoulder, by which the lift movement is limited, can optionally be provided on the pressure-transmission element and/or the guide element. In this way, the working lift of the valve-closing element is limited, by virtue of which limited opening of the passage opening takes place in order to achieve a mass flow with a small flow rate. This development has the advantage that the components of the expansion valve, with the exception of the pressure-transmission element or guide element, are constructionally identical to previous expansion valves.

The object according to the invention is furthermore achieved by an expansion valve in which the maximum mass flow is limited by an annular gap which is formed between the passage opening and a transmission pin arranged therein of an actuating device. This development has the advantage that limitation of the mass flow is afforded independently of the working lift of the valve-closing element. Consequently, the volume of the mass flow can be determined by a ball seat cross section in a first opening phase. As soon as a maximum working lift is achieved, the ball seat cross section can be designed to be the same as the annular gap formed between the transmission pin and the passage opening. If the working lift opens further owing to tolerances of the valve-closing element, the mass flow remains limited by the annular gap.

This combination of ball seat cross section, adapted working lift and/or adaptation of the downstream annular cross section allows the opening characteristic to be designed even flatter, for example, which means a smoother control response of the valve.

According to an advantageous development of the invention, the passage opening is designed as a bore in a housing. This makes cost-effective manufacture without additional components possible.

In this embodiment according to the invention, a ratio of the diameter of the transmission pin to the diameter of the passage bore of 0.88 is preferably provided in a range between +13% and −50%. Optimum working results can be obtained in this range. In this connection, both the diameter of the transmission pin and/or the diameter of the passage opening can be changed and adapted to one another. The portions of the transmission pin arranged in the passage opening are preferably changed in diameter. A greater free gap dimension can be achieved by limiting the output via the annular cross section than in the case of limitation via the ball cross section, by virtue of which the susceptibility to dirtying is considerably reduced. The gap dimension in the annular cross section can preferably be passable for up to 70% larger particles in comparison with the conical seat cross section, or have a correspondingly larger gap dimension.

According to the invention, the object is furthermore achieved by a nozzle element which is provided before or after the valve seat. By virtue of this, the volume flow can be throttled to a small maximum flow rate and limitedly.

According to an advantageous development of the invention, a nozzle element or a passage with a fixed cross section is provided in a cooling-medium inlet opening or cooling-medium outlet opening. By virtue of this, a compact arrangement of an expansion valve can be maintained. The nozzle element is preferably pressed in. For the configuration of variable housings, the nozzle elements can also be connected to the housing by a screwed connection. This also makes conversion possible. The use of nozzle elements also serves to reduce the susceptibility to dirtying. The fixed cross section of the bore in the nozzle element or of the passage is preferably designed to be equal to or smaller than 2.5 mm.

The developments according to the invention can be combined with one another as required and/or adapted to one another.

BRIEF DESCRIPTION OF THE DRAWINGS

The invention and further advantageous embodiments and developments thereof are described and explained in greater detail below with reference to the examples illustrated in the drawings. The features to be inferred from the description and the drawings can be applied according to the invention individually or together in any combination. In the drawing.

DETAILED DESCRIPTION OF THE INVENTION

Figure 1:
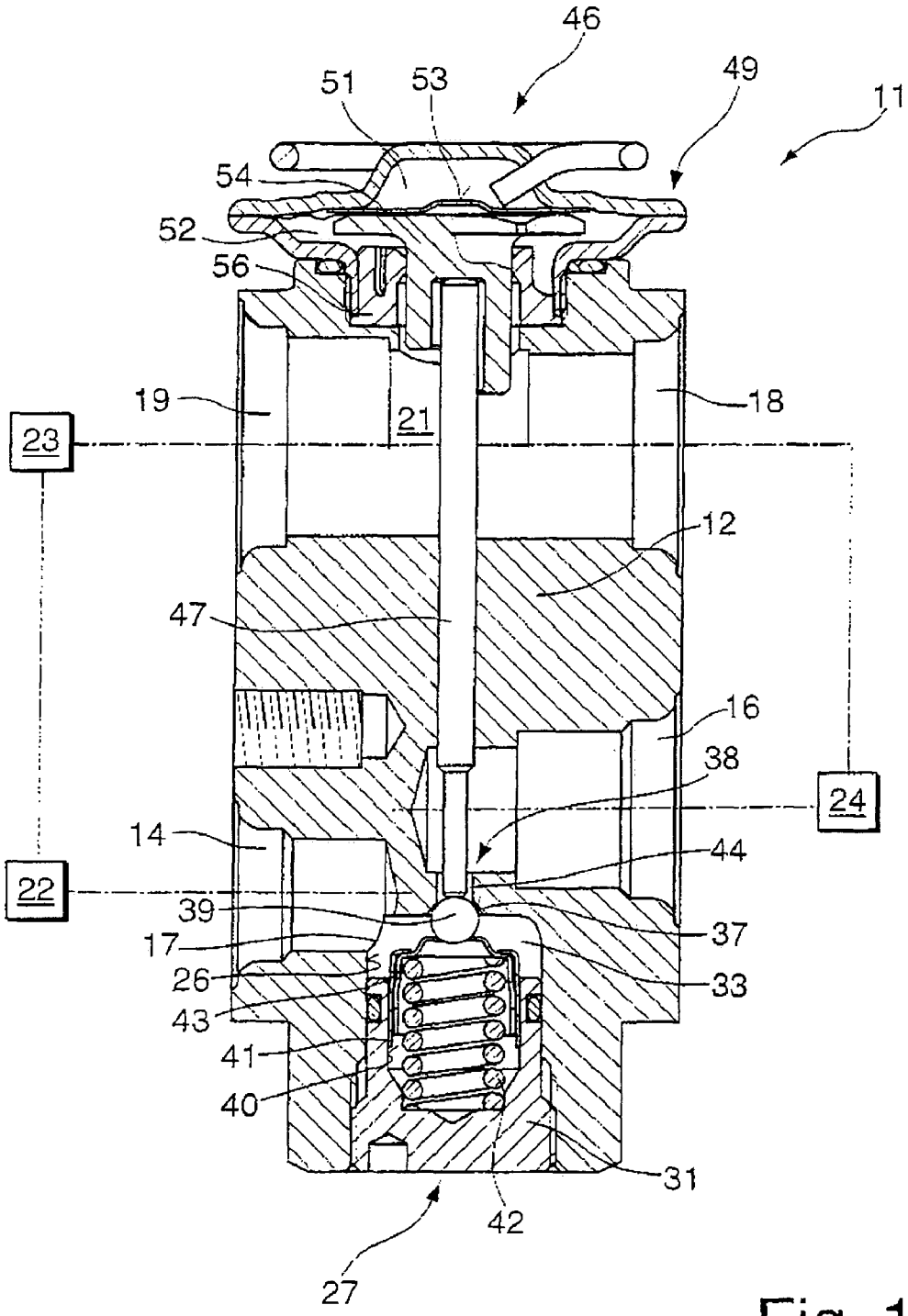
FIG. 1 shows a diagrammatic sectional illustration of an expansion valve according to the invention.

An expansion valve 11 is illustrated by way of example in FIG. 1. This valve comprises a housing 12 with a first cooling-medium inlet opening 14, a first cooling-medium outlet opening 16 and a cooling-medium duct 17 connecting the first cooling-medium inlet opening 14 and the first cooling-medium outlet opening 16. A second cooling-medium inlet opening 18 and a second cooling-medium outlet opening 19, which are interconnected by a second cooling-medium duct 21, are also provided in the housing 12. The outlet side of a condenser 22, the inlet side of which is connected to the outlet side of a compressor 23, is connected to the first cooling-medium inlet opening 14. The inlet side of the compressor 23 is connected to an outlet side of an evaporator 24.

The housing 12 of the expansion valve 11 comprises a housing portion 26 which extends into the housing interior and into a part of the cooling-medium duct 17. A regulating device 27 can be inserted into the housing portion 26. According to the illustrative embodiment, the regulating device 27 is integrated completely in the housing 12 to reduce the construction space. In addition, the regulating device 27 can be actuatable by a travel-generating device and a switch-off valve.

The regulating device 27 comprises a regulating screw 31 which preferably engages on the housing portion 26 via a thread. A valve arrangement 36, which comprises a valve seat 37 arranged on the housing 12, is provided in a regulating space 33. A valve-closing element 39 is positioned in a closing position 38 in the valve seat 37. The valve-closing element 39 is designed as a ball valve. The valve-closing element 39 comprises inter alia a damping element 41 which comprises damping tongues 43 engaging in a bore portion 40 and is connected to a regulating spring 42 arranged in the bore portion 40. In the closing position 38, the valve-closing element 39 closes a passage opening 44 which is provided between the first cooling-medium inlet opening 14 and the first cooling-medium outlet opening 16.

For actuation of the valve-closing element 39, an actuating device 46 designed as a thermohead 49 is provided, which acts on the valve-closing element 39 via a transmission pin 47 and opens and closes the valve arrangement 36.

According to a first embodiment according to the invention, a small maximum mass flow rate of cooling medium is achieved by limitation of the maximum working lift of the valve-closing element 39 out of the valve seat 37. According to this first embodiment, the transmission pin 47 designed as one part or a number of parts is adapted in its overall length. This can be effected, for example, by shortening the length, which is shortened by up to 0.5 mm in relation to the transmission pin otherwise used, for example. By virtue of this, the maximum opening lift is reduced and ends at a defined opening point. At the same time, the maximum mass flow is determined by a ball seat cross section which arises in an opening position of the valve-closing element 39 in relation to the conical surface of the valve seat 37 and forms an annular gap or an annular area which can be flowed through. The maximum working lift is designed in such a way that the ball seat cross section, or annular gap between valve-closing element and valve seat flowed through by the mass flow, is designed always to be smaller than an annular gap area between the transmission pin 47 and the passage opening 44. The working lift can be reduced by at least 30% by the lift-limiting transmission pin 47, for example. The transmission pin 47 is preferably designed in a ratio of greater than/equal to 0.97 in relation to the non-limiting transmission pin 47.

The thermohead 49 of the actuating device 46 comprises an upper and a lower chamber 51, 52, which are separated from one another by a membrane 53. In the lower chamber 52, a pressure-transmission element 54 is guided by a guide element 56, an expansion in the upper chamber 51 acting on the membrane 53 which in turn actuates the pressure-transmission element 54, so that the transmission pin 47 carries out a working lift and acts on the valve-closing element 39. As an alternative to adapting or shortening the transmission pin 47, the lift travel of the pressure transmission element 54 in the guide element 56 can also be limited. Depending on the configuration, the pressure-transmission element 54 and/or the guide element 56 can have guide portions designed accordingly in length or projections in order to limit the maximum lift.

Alternatively, the membrane 53 can be prestressed in the direction of the valve-closing element 39 by a filling medium, so that a transmission pin 47 of shortened design bears against the valve-closing element 39.

A further limitation of the mass flow according to the invention is afforded by determining the annular gap cross section. The transmission pin 47 is preferably provided in a diameter ratio to the passage bore 44 of 0.88 in a range between +13% and −50%. By virtue of this, restriction of the mass flow can also be achieved independently of the lift travel. Otherwise the geometry of the transmission pin and of the housing 12 of the expansion valve 11 is maintained.

Figure 2:
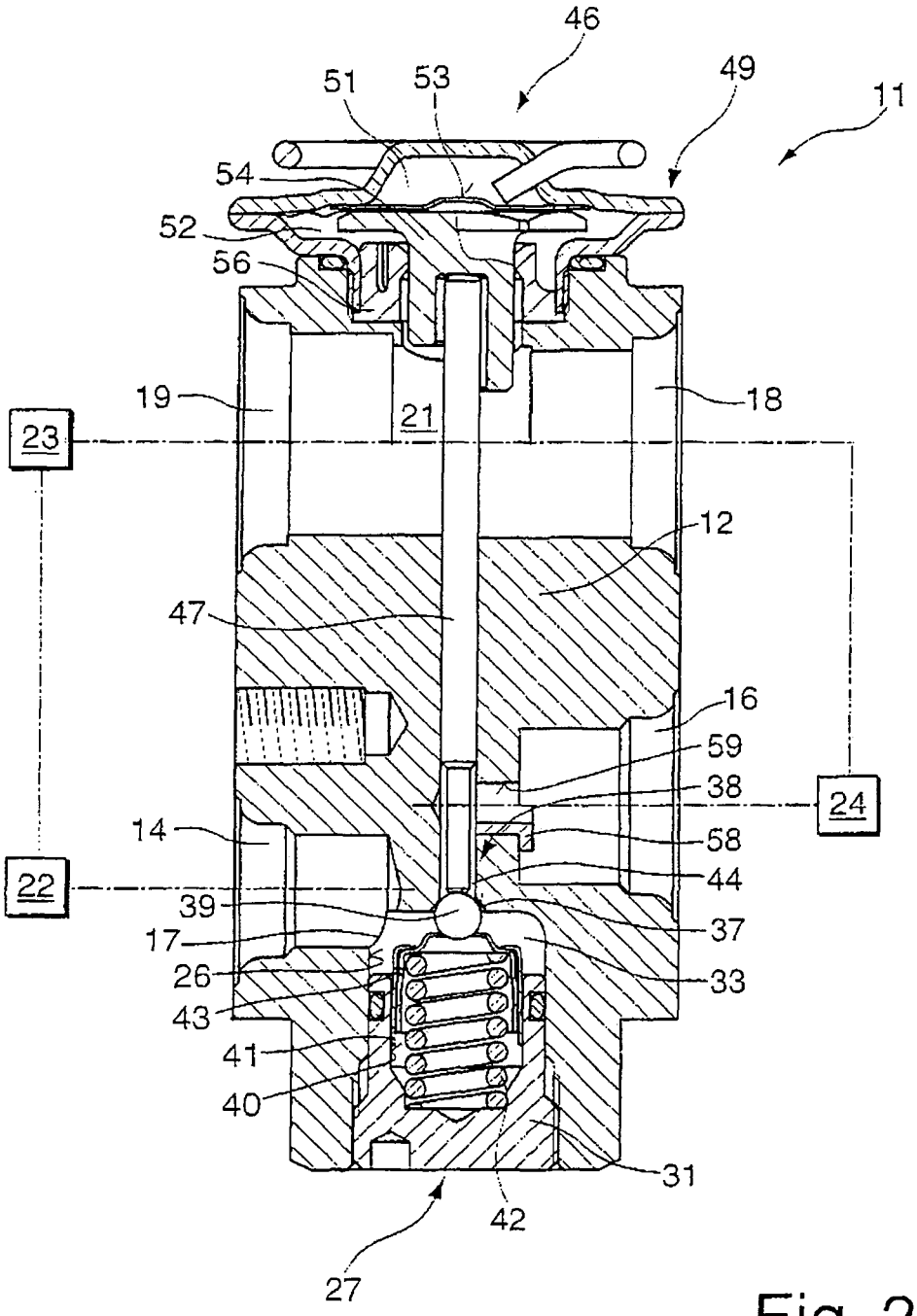
FIG. 2 shows a diagrammatic sectional illustration of an alternative embodiment of an expansion valve.

According to a further development according to the invention, restriction of the mass flow is effected by a nozzle element 58 independently of the working lift of the valve-closing element 39. This nozzle element 58 can, as illustrated in FIG. 2, be provided in the cooling-medium outlet opening 16 after the passage opening 44. Such a nozzle element 58 can likewise be arranged in the cooling-medium inlet opening 14. Depending on the installation location, the diameters are designed differently in size and preferably with a fixed cross section in order to achieve the desired restriction of the mass flow with the respective state of aggregation of the cooling medium before and after the valve. Alternatively, a passage with a fixed cross section 59 can be provided between the passage opening 44 and the cooling-medium outlet opening 16. The nozzle element 58 and the passage 59 preferably have a diameter which is equal to or smaller than 2.5 mm. Both the nozzle element 58 and the passage bore 59 are illustrated in the half section.

Furthermore, provision is made as a development according to the invention for achieving a restricted mass flow that an inclination of a conical surface of the valve seat 37 is designed as a function of a diameter size of the valve-closing element 39. In the case of a conical surface with a large angle between the two conical seat surfaces and a valve-closing element with a small diameter, it is possible to achieve a rapid increase in the mass flow with a small lift. In the case of a valve-closing element with a relatively large diameter, which sits in conical surfaces of the valve seat 37 which enclose a small angle, it is possible to achieve a slow increase in the mass flow with a larger working lift.

Figure 3:
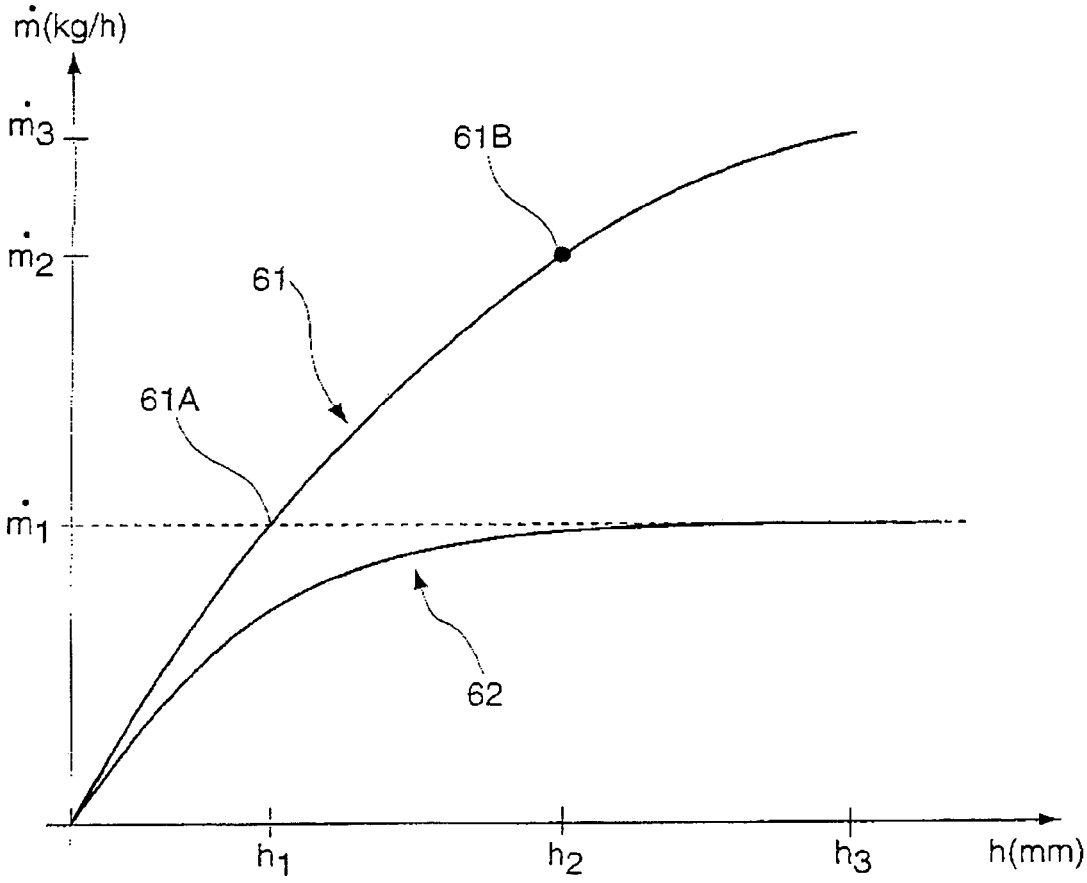
FIG. 3 shows a diagram with characteristic curves of the expansion valves according to the invention.

FIG. 3 illustrates a diagram with characteristic curves 61 and 62 of the expansion vales 11 according to the invention. The characteristic curve 61 shows a shape with a standard expansion valve, the nominal output of which is evaluated at the point 61B at a mass flow m2 and a nominal lift h2. In operation, the expansion valve has a mass flow m3 at a maximum working lift h3 after the valve-closing element 39 has opened. To reduce the output and consequently the mass flow, it has surprisingly been found that shortening the transmission pin 47 is sufficient in order to achieve output limitation at point 61A, for example. The other geometries of the expansion valve can be maintained. By virtue of this, targeted limitation of the mass flow can be effected in a simple way. To limit the output to a mass flow m1, the transmission pin 47 was shortened so that it exerts a limited working lift of h1 on the valve-closing element 39. It was possible to maintain a relatively steep and virtually rectilinear shape of the characteristic curve 61. After complete opening of the valve-closing element 39 on the basis of the predetermined working lift, limitation of the mass flow m1, which is adapted to the output of the cooling-medium circuit and ends at the point 61A, takes place.

Compared with the characteristic curve 61, the characteristic curve 62 has a smoother rise and consequently a smoother control response. Such a smoother control response can be achieved in particular by limiting the annular cross section in the passage opening 44. By virtue of this, the risk of dirtying is also reduced at the same time. The gap dimension of the annular cross section can be designed to be at least twice as large with the same output limitation. The smallest gap dimension determining the mass flow is thus increased. In addition, limitation of the working lift can alternatively also be provided by shortening the transmission pin 47. Furthermore, an upstream or in particular downstream nozzle element 58 can also be provided in combination with dimensioning the conical seat cross section and/or the annular cross section and/or the working lift of a valve-closing element 39 in order to achieve the smoother control response. This adaptation of the parameters furthermore has the advantage that good resolution of the control response is made possible for expansion valves with a small output. Moreover, the individual parameters can also be determined and adapted as a function of the output of the cooling-medium system and in relation to its design.

The developments described above, in each case according to the invention individually, for an expansion valve with a small mass flow rate, preferably of less than 100 kg/h at a condensation temperature of 38° C., undercooling of 5 K and an evaporation temperature of 0° C., can be combined with one another as required. In a combination, the individual parameters are advantageously adapted to one another in order to achieve maximum efficiency in the output result.

The invention claimed is:

1. Expansion valve for a vehicle air-conditioning system operated with cooling medium, with a valve seat and a valve-closing element, which closes a passage opening between a cooling-medium inlet opening and a cooling-medium outlet opening, and with an actuating device which acts on the valve-closing element and opens and closes the passage opening, characterized in that a passage or a nozzle element limiting mass flow in each case with a fixed cross section, is provided before or after the valve seat and further characterized in that a shortened maximum working lift for opening the valve-closing element out of the valve seat is provided, at which a ball seat cross section formed between valve-closing element and valve seat is designed to be smaller than an annular gap formed between a transmission pin of the actuating device and the passage opening.

2. Expansion valve according to claim 1, characterized in that the nozzle element is provided in a cooling-medium inlet opening or a cooling-medium outlet opening.

3. Expansion valve according to claim 1, characterized in that the actuating device comprises a transmission pin shortened in length which, at a maximum working travel of a thermohead of the actuating device, generates a limited working lift of the valve-closing element.

4. Expansion valve according to claim 1, characterized in that an adapted or lift-limiting transmission pin is in a ratio to a non-lift-limiting transmission pin which is equal to or greater than 0.97.

5. Expansion valve according to claim 1, characterized in that a thermohead of the actuating device comprises a membrane which divides the thermohead into an upper chamber and lower chamber and a filling medium with an elevated pressure is provided in the upper chamber.

6. Expansion valve according to claim 5, characterized in that a filling medium which is different from a cooling medium flowing through the passage opening is provided in the upper chamber of the thermohead.

7. Expansion valve according to claim 1, characterized in that a pressure-transmission element arranged in a thermohead of the actuating device is guided axially displaceably in a guide element and a stop limiting working travel of a membrane is provided on the pressure-transmission element or guide element.

8. Expansion valve according to claim 1, characterized in that a mass flow passing from the cooling-medium inlet opening to the cooling-medium outlet opening is limited by an annular gap formed between a transmission pin of an actuating device, which pin is arranged in a passage opening, and the passage opening.

9. Expansion valve according to claim 8, characterized in that the passage opening is designed as a bore in a housing.

10. Expansion valve according to claim 8, characterized in that a diameter of the transmission pin is in relation to the diameter of the passage bore provided in a ratio of 0.88 in a range between +13% and −50%.

11. Expansion valve according to claim 8, characterized in that the maximum working lift is limited to less than 0.4 mm.

* * * * *